United States Patent [19]

Yamamoto et al.

[11] 4,360,762

[45] Nov. 23, 1982

[54] RAPID STARTER SWITCH FOR A FLUORESCENT LAMP

[75] Inventors: Seiichiro Yamamoto; Hiromi Adachi, both of Kamakura; Shoichi Iwaya, Kisagata, all of Japan

[73] Assignees: TDK Electronics Co., Ltd.; Mitsubishi Denki Kabushiki Kaisha, both of Tokyo, Japan

[21] Appl. No.: 217,986

[22] Filed: Dec. 18, 1980

[30] Foreign Application Priority Data

Dec. 21, 1979 [JP] Japan ..... 54-177599[U]
Dec. 21, 1979 [JP] Japan ..... 54-177600[U]

[51] Int. Cl.[3] ..... H05B 39/00

[52] U.S. Cl. ..... 315/101; 315/103; 361/281; 361/321

[58] Field of Search ..... 361/322, 321, 315, 311, 361/303, 281; 315/101

[56] References Cited

U.S. PATENT DOCUMENTS

| | | | |
|---|---|---|---|
| 2,566,666 | 9/1951 | Khouri et al. | 361/321 |
| 2,633,543 | 3/1953 | Howatt | 361/281 |
| 3,410,705 | 11/1968 | Honma | 361/321 |
| 3,914,646 | 10/1975 | Paupy | 315/103 |
| 4,119,886 | 10/1978 | Jyomura et al. | 315/101 |
| 4,119,887 | 10/1978 | Iyama et al. | 315/101 |

*Primary Examiner*—Harold A. Dixon
*Attorney, Agent, or Firm*—Armstrong, Nikaido, Marmelstein & Kubovcik

[57] ABSTRACT

An improved starter switch which provides a rapid firing of a fluorescent lamp within 0.8 second has been found. An external appearance and the size of the present starter switch are almost the same as those of a prior glow switch which is slow to fire a fluorescent lamp, therefore, the present starter switch is replaceable to a prior glow switch by merely inserting the present starter switch to a socket of a prior glow switch. The present starter switch has a connector cap which is to be able to be engaged with a socket for a glow switch, a printed circuit board mounting circuit components and connected to said connector cap by lead lines, and a housing fixed to said cap and covering said printed circuit board. The circuit elements mounted on the printed circuit board include at least a non-linear capacitor which has a saturation characteristics between a voltage applied to the capacitor and the charge stored in the same, and a semiconductor switch which conducts upon the application of the voltage higher than a predetermined threshold voltage and holds the conductive status until the current in the same reaches almost zero. Following to the switching OFF of the semiconductor switch when the source current is almost zero but the source voltage is almost maximum due to the presence of an inductive ballast, the non-linear capacitor is charged but is saturated in a short time, then, the charge current of the capacitor is interrupted. The interruption of the charge current of the non-linear capacitor induces the high firing pulse voltage in a ballast inductor which is connected in series with a fluorescent lamp, and said pulse voltage fires a lamp.

18 Claims, 15 Drawing Figures

RAPID STARTER SWITCH FOR A FLUORESCENT LAMP

BACKGROUND OF THE INVENTION

The present invention relates to the improvement of a starter switch for a fluorescent lamp, and in particular, relates to such a starter switch which fires a fluorescent lamp very quickly.

Generally, a fluorescent lamp system, a sodium lamp system or a mercury lamp system, has a discharge lamp 1 with a pair of hot cathodes 1*a* and 1*b*, a ballast 2 which is implemented by an inductor for providing the high firing voltage for starting a discharge lamp and restricting a discharge current after fired, and a glow switch G with a bimetal. In that conventional fluorescent lamp system, when a switch SW is turned ON, a circuit through a ballast 2, a pair of cathodes 1*a* and 1*b* of a fluorescent lamp 1 and a glow switch G is completed, and an electric current flows in that circuit. Thus, the hot cathodes 1*a* and 1*b* are heated. Then, said glow switch G is switched OFF. Due to the sudden switching OFF of the current by the glow switch, the inductor 2 generates the high voltage which fires the lamp 1. When the discharge of the lamp starts, the current in the lamp is restricted by the inductor 2.

However, a conventional fluorescent lamp system has the disadvantages that it takes long to start the discharge of a fluorescent lamp. Usually, it takes more than three seconds to lighting a lamp after a switch is turned ON. Therefore, a quick start lamp which lights just when a switch is turned ON has been requested. Another disadvantage of a conventional fluorescent lamp is the presence of a glow switch, which has a bimetal. Due to the presence of a bimetal which has a metal contact, the life time of that contact is not long, and we must change a glow switch often.

Some proposals for overcoming said disadvantages of a conventional fluorescent lamp have been known, and a quick start fluorescent lamp, a rapid start fluorescent lamp or an instant start fluorescent lamp have been known. However, those quick start type fluorescent lamps have the disadvantage that the particular structure of a lamp must be utilized. Therefore, those proposals can not shorten the start time of a conventional glow switch type fluorescent lamp.

SUMMARY OF THE INVENTION

It is an object of the present invention to provide a new and improved starter switch by overcoming the disadvantages and limitations of a prior fluorescent lamp system.

It is also an object of the present invention to provide a starter switch which provides a rapid firing of a fluorescent lamp and is able to be engaged with a socket of a prior glow switch.

The above and other objects are attained by a starter switch having a connector cap for connecting electrically the present starter switch to an external circuit and supporting the present starter switch and that cap being able to be engaged with a socket for a prior glow switch for a fluorescent lamp; a printed circuit board mounting at least a non-linear capacitor having the non-linear saturation characteristics between a voltage applied to the capacitor and the charge stored in the capacitor, and a semiconductor switching circuit connected substantially parallel to that non-linear capacitor; a pair of lead lines for providing the electrical coupling between said printed circuit board and said connector cap, and for supporting said printed circuit board; and a housing fixed to said connector cap and covering said printed circuit board and said lead lines.

According to another embodiment of the present starter switch, a non-linear capacitor is shaped in a cylindrical form, and a printed circuit board is fixed within the cylindrical capacitor. In this configuration, a large capacitance of a non-linear capacitor is obtained because the large size of a non-linear capacitor is available in a relatively small housing.

Preferably, the dielectric body of said non-linear capacitor is composed of polycrystal body of $B_aT_iO_3$ and $B_aS_nO_3$ with the 90 through 98 mol % of $B_aT_iO_3$ and 10 through 2 mol % of $B_aS_nO_3$, and the average diameter of a sintered body of crystals being in the range from $10\mu$ to $60\mu$.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1A:
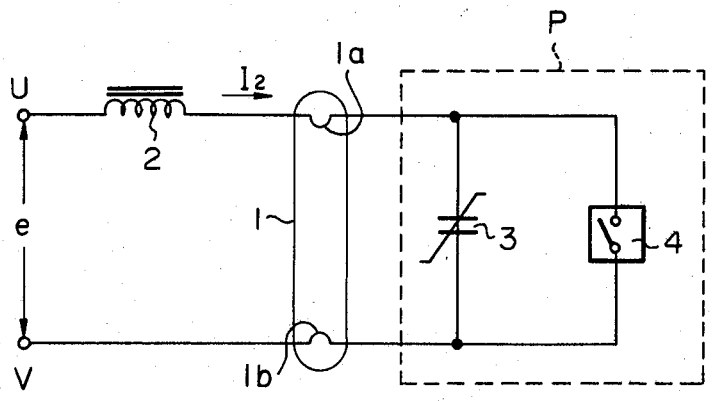
FIG. 1A and FIG. 1B show a circuit diagram of the fluorescent lamp system utilizing the present starter switch.
Figure 1B:
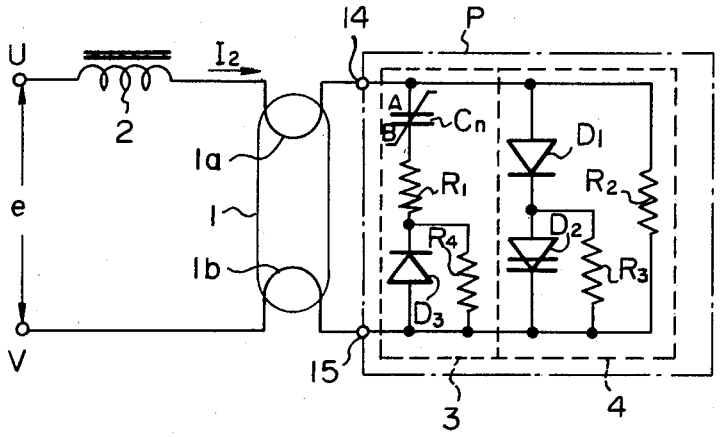
Figure 2A:
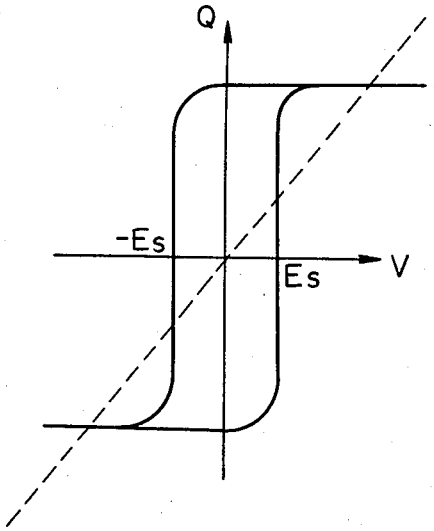
FIG. 2A and FIG. 2B show the characteristics of a non-linear capacitor utilized in the present invention.
Figure 2B:
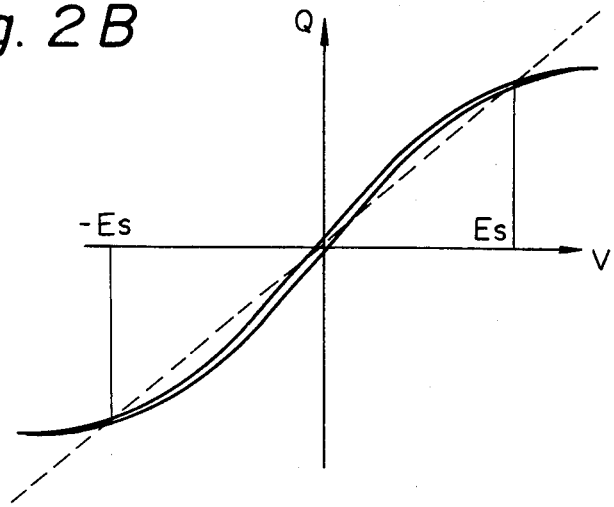

FIG. 1A shows a circuit diagram of a fluorescent lamp system utilizing the present invention, and that circuit provides the quick start of lighting of a lamp. In FIG. 1A, the reference numeral 1 is a fluorescent lamp or a discharge lamp having a pair of hot cathodes 1*a* and 1*b*, 2 is a ballast which is implemented by an inductor for restricting the discharge current in the lamp 1 and facilitating the start of the lighting of the lamp 1. The reference numeral 3 is a capacitor having non-linear characteristics as shown in FIGS. 2A and 2B. The reference numeral 4 is a switching circuit which is implemented by a semiconductor element. The combination P having said non-linear capacitor 3 and the switching circuit 4 composes a starter switch, and it should be appreciated that the starter switch P can replace a prior glow switch without any change in other circuits of a conventional glow switch type fluorescent lamp. That is to say, the mere replacement of a prior glow switch to the present starter switch P provides a rapid start fluorescent lamp. The circuit diagram of the starter switch P is shown in FIG. 1B.

Figure 3:
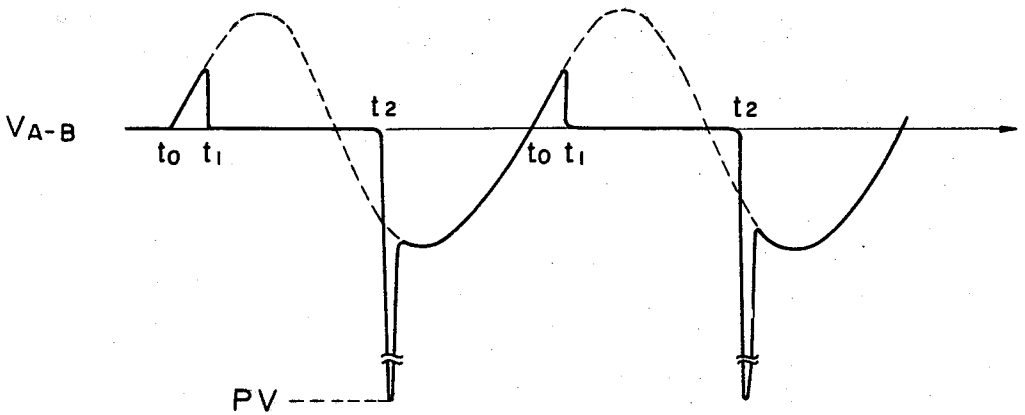
FIG. 3 shows the waveform of the voltage across the non-linear capacitor in the present starter switch.

First, the theoretical analysis of the rapid start system is described in accordance with FIGS. 2A, 2B and 3.

FIGS. 2A and 2Bshow a non-linear characteristics of the capacitor 3, and the horizontal axis shows the voltage applied across the capacitor, and the vertical axis shows the charge stored in th capacitor 3. It should be appreciated that the relation between the voltage and the charge in an ordinary capacitor is linear as shown by the dotted lines in FIGS. 2A and 2B. The non-linear capacitor as shown by the solid lines of FIGS. 2A and 2B is obtained by using ferroelectric substance like Barium-titanate as a dielectric layer sandwiched by a pair of electrodes of a capacitor. When the ferroelectric substance is single crystal, the hysteresis characterstics as shown in FIG. 2A is obtained, and when the ferroelectric substance is polycrystal, the saturation characteristics as shown in FIG. 2B is obtained. It should be appreciated in FIGS. 2A and 2B that the charge stored in a capacitor saturates. Therefore, when a non-linear capacitor is saturated, no current flows into a capacitor even when a voltage is applied across a capacitor. The use of that non-linear capacitor is the important feature of the present invention. That non-linear capacitor is supplied by TDK Electronics Co., Ltd., Tokyo, Japan.

Now returning to FIGS. 1A and 1B, the starter switch P has a series circuit of the resistor $R_1$, the non-linear capacitor $C_n$ and the parallel circuit of the diode $D_3$ and the resistor $R_4$. This series circuit is indicated by the reference numeral 3 in FIG. 1A for the sake of the simplicity. The switching circuit 4 has a series circuit of the diode $D_1$ and a break-over semiconductor switch $D_2$. The resistor $R_3$ is connected parallel to said semiconductor switch $D_2$, and another resistor $R_2$ is connected parallel to the series circuit of the diode $D_1$ and the semiconductor switch $D_2$. It is supposed that a break-over semiconductor switch functions to conduct when the voltage across the semiconductor switch exceeds a first predetermined value, and to maintain the conductive status so long as the current in the semiconductor switch is higher than another predetermined value which is lower than the first predetermined value. The semiconductor switch of that nature is implemented by a Shockley diode, or a silicon-controlled-rectifier (SCR). In FIG. 1B, the polarity or the direction of the diode $D_3$ is opposite to that of the diode $D_1$. The resistors $R_1$, $R_2$, $R_3$ and $R_4$ are provided for the stable operation of the circuit.

Now, the operation of the starter switch of the present invention is described in accordance with FIG. 1B and FIG. 3. It is supposed that an alternating current (AC) voltage (e) is applied across the terminals U and V, and at the initial condition (time $t_0$) it is supposed that the semiconductor switch $D_2$ is not conductive. When the source voltage (e) increases in the positive half cycle, the voltage substantially equal to the value (e) is applied to the semiconductor switch $D_2$. Therefore, when the instantaneous voltage of the source voltage reaches the break-over voltage of the semiconductor switch $D_2$ at time $t_1$ (see FIG. 3), said semiconductor switch $D_2$ conducts, and then, the alternating current flows in the circuit from the terminal U, through the ballast 2, the first filament 1*a* of the lamp 1, the diode $D_1$, the semiconductor switch $D_2$, the second filament 1*b* of the lamp 1, to the terminal V. Said electric current pre-heats the filaments 1*a* and 1*b*. The voltage across the non-linear capacitor $C_n$ is almost zero during the semiconductor switch $D_2$ is conductive as shown in FIG. 3. FIG. 3 shows the voltage across the non-linear capacitor $C_n$ in the solid line. When the electric current in the semiconductor switch $D_2$ decreases, and that current is lowered than the holding current of the semiconductor switch $D_2$, the semiconductor switch $D_2$ is switched OFF to the non-conductive status.

In this case, it should be noted that the ballast 2 which is an inductive element exists. In an inductive element, the current $I_2$ in the ballast 2 is delayed by approximate 90 degrees compared with the voltage. Accordingly, when the semiconductor switch $D_2$ is turned OFF at the time $t_2$ of FIG. 3, the voltage is in the negative region succeeding to the previous positive region as shown in FIG. 3. It should be noted that voltage is short-circuited by the semiconductor switch $D_2$ when that switch $D_2$ is conducted. When the switch $D_2$ is switched OFF, that voltage is not short-circuited any more, and then, the non-linear capacitor $C_n$ is charged to the high voltage with the electrode A negative and the electrode B positive in the notation of FIG. 1B. However, since the capacitor $C_n$ has the saturation characteristics as shown in FIGS. 2A or 2B, the capacitor $C_n$ saturates in a short time, and the charge current into the capacitor $C_n$ is decreased suddenly or interrupted. The interruption of the current in the capacitor $C_n$ provides the interruption of the current in the inductive ballast 2, and then, the inductive ballast 2 induces the high counter electromotive voltage relating to the inductance of the ballast 2 and the differentiated current ($dI_2/dt$). That counter electromotive voltage which is higher than the firing voltage of the lamp 1, triggers the lighting of the lamp 1 on the condition that the filaments 1*a* and 1*b* are pre-heated. Since the above operation is repeated in every cycle of the alternating power source voltage, the filaments 1*a* and 1*b* are pre-heated during $t_1$ and $t_2$ (see FIG. 3), and those filaments are well pre-heated in a short time.

In the above configuration, the starting time from a switch (not shown) being turned ON to the firing of the lamp 1, or the pre-heat time of the filaments, is considerably shorter than that of a conventional glow switch type fluorescent lamp. According to the preferred embodiment of the present invention, the starter switch in FIG. 1B lights a fluorescent lamp in 0.4~0.8 second.

In order to assure the above operation, the breakover voltage of a semiconductor switch $D_2$ must be higher than the discharge voltage for maintaining the discharge in a lamp 1 so that the semiconductor switch $D_2$ does not conduct after the lamp 1 is fired. Further, it should be noted that the saturation voltage $E_s$ of a non-linear capacitor $C_n$ must be lower than the peak voltage of the power source.

It should be appreciated that the starter switch P according to the present invention is completely compatible with a prior glow switch as far as an electrical circuit concerns. Therefore, if the size of the starter switch P is almost the same as that of a conventional glow switch, and the socket or the connector pins of the present starter switch is the same as that of a conventional glow switch, the present starter switch can replace a glow switch in a conventional fluorescent lamp system. That compatible starter switch is possible by utilizing a small size of non-linear capacitor, together with conventional diodes, resistors and a semiconductor switch. The small size of non-linear capacitor with the excellent characteristics is possible by using the particular dielectric layer described later. Thus, the present starter switch P can be mounted in a housing with the size of 18 mm of diameter and 40 mm of height, or 22 mm of diameter and 38 mm of height, which is completely compatible with a conventional glow switch.

Now, the mechanical structure of the compatible starter switch according to the present invention is described.

Figure 4A:
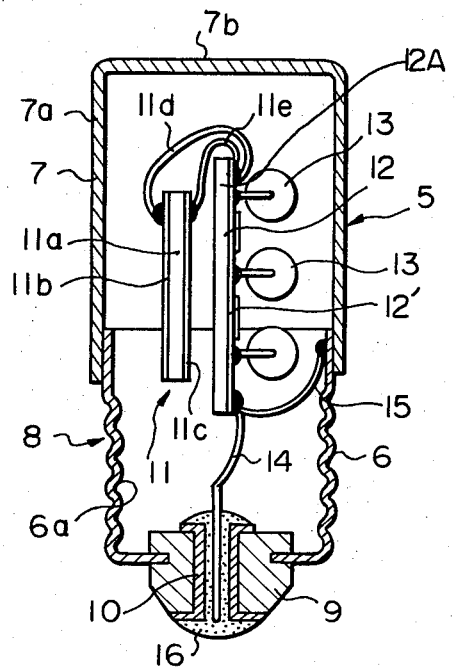
FIG. 4A is the structure of the starter switch according to the present invention.

FIG. 4A shows the structure of the present starter switch. In FIG. 4A, a housing 5 having a cylindrical cover or a casing 7 and a conductive cylindrical screw cap 6 which operates as a connector, is provided. The cover 7 has a cylindrical side wall 7*a* and a circular top plate 7*b*, and the cover 7 is made of non-conductive material like plastics. The screw cap 6 which is conductive and is adhered to the cover 7, has a cylindrical side wall 6*a* which has screw 8 and a dielectric body 9 at the extreme end of the screw cap 6. Also, a conductive member 10 is provided at the center of the dielectric body 9 so that the conductive member 10 is insulated from the side wall 6*a*. It is supposed that the structure of the screw cap 6, including the diameter, the length, and the pitch of the screw 8, is designed so that the present starter switch is compatible with a prior glow switch.

The printed circuit board 12 having the dielectric plate 12A and the conductive printed pattern 12' on one surface of said dielectric plate 12A is provided, and the circuit components 13 (including the diode $D_1$, the semiconductor switch $D_2$, the diode $D_3$, the non-linear capacitor $C_n$, and the resistors $R_1$ through $R_4$) are mounted on the printed circuit board 12. Those circuit components are discrete components rather than an integrated circuit, since the scale of the circuit is small, and the manufacturing cost of the circuit using discrete components is lower than that using an integrated circuit in the present invention.

The printed circuit board 12 is fixed to the screw cap 6 by the lead lines 14 and 15. One end of the lead line 14 is connected to the printed circuit board 12 and the other end of the lead line 14 is soldered to the conductive member 10 by the solder 16. On the other hand, one end of the other lead line 15 is connected to the printed circuit board 12 and the other end of the lead line 15 is soldered to the inner wall of the screw cap 6. Thus, when the present starter switch is inserted in a socket of a glow switch, the present apparatus is connected to the circuit through the lead lines 14 and 15. The lead lines 14 and 15 double as a support for supporting the printing circuit board 12 in the housing 5.

Figure 4B:
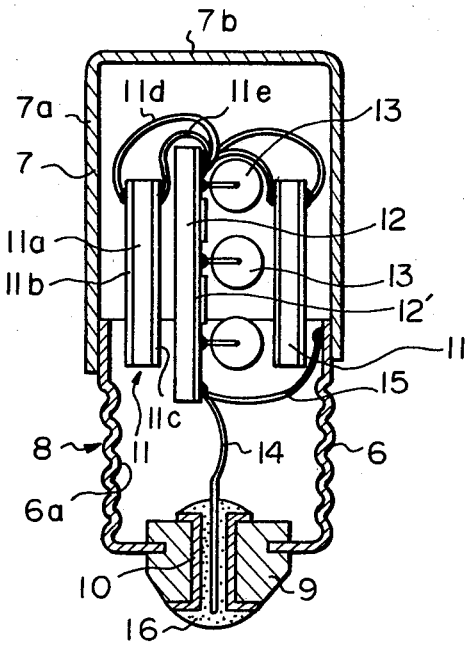
FIG. 4B is the modification of the structure of FIG. 4A, FIGS. 5A and 5B show the printed circuit board having circuit elements in the starter switch of FIG. 4A.

The non-linear capacitor 11 ($C_n$) which has a circular or a rectangular dielectric disk 11*a* and a pair of electrodes 11*b* and 11*c* attached on the surfaces of said disk 11*a*, is also mounted on the circuit pattern 12' on the printed circuit board 12 through the lead lines 11*d* and 11*e*. The ends of those lead lines 11*d* and 11*e* are connected to the electrodes 11*b* and 11*c*, respectively. The dielectric disk 11*a* is composed of the polycrystal material made of $B_a(T_i-S_n)O_3$ system in the present embodiment. In that polycrystal material, the steep rising characteristics in the voltage-charge curve (see FIG. 2A or FIG. 2B) is obtained, and that steep rising curve provides the high counter electromotive voltage in the ballast 2, which facilitates the stable firing operation of a fluorescent lamp. The composition of the dielectric disk 11*a* is described in more detail later in accordance with FIGS. 9 and 10. Preferably, a pair of non-linear capacitors 11 and 11A are utilized as shown in FIG. 4B. In that case, those two capacitors are connected parallel to each other to provide the higher counter electromotive voltage.

The dielectric disk 11*b* vibrates mechanically when an alternating current voltage is applied to the capacitor, since that dielectric disk is made of ferroelectric material. In order to absorb that vibration and prevent the vibration to be transferred to the printed circuit board, the lead lines 11*d* and 11*e* of the capacitor are preferably longer than 7 mm, and 0.5–0.8 mm in diameter, when those lead lines are made of copper. In view of the absorption of the vibration, the thinner diameter is preferable, and that proposed diameter is a compromise to absorb the vibration and to support the weight of the capacitor by the lead lines. Further, the length of the lead lines 11*d* and 11*e* is preferably equal to each other so that the stress in the lead lines due to the vibration distributes equally to the two lead lines.

Figure 5A:
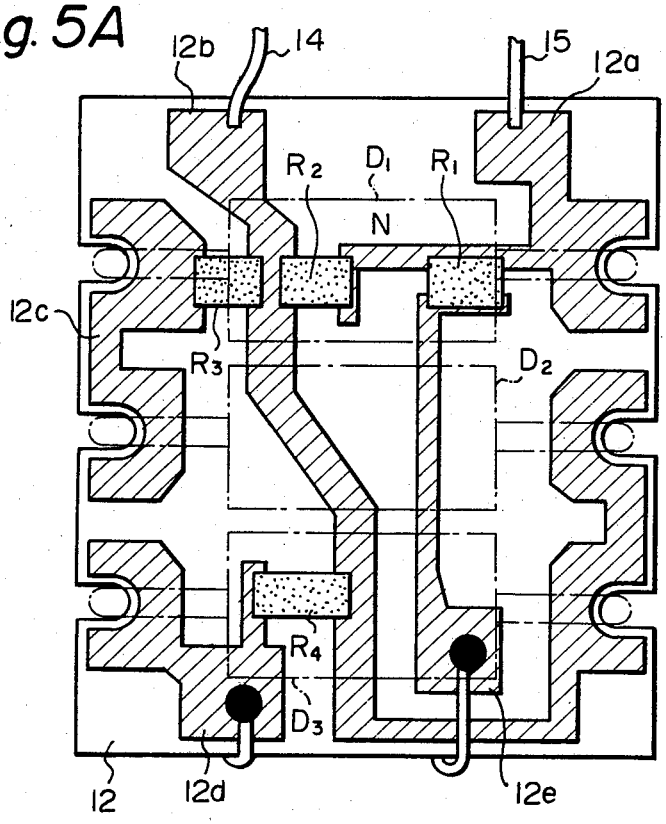
Figure 5B:
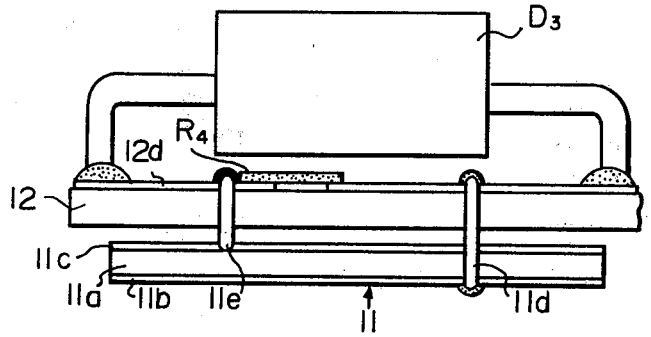

FIG. 5A shows the plane view of the printed circuit board 12 with the circuit components, and FIG. 5B is the vertical view of the device of FIG. 5A. The printed circuit board 12 has the conductive patterns 12*a*, 12*b*, 12*c*, 12*d* and 12*e* on the dielectric plate. Those patterns are provided for instance through a screen printing process on the dielectric plate. The resistor $R_1$ is connected between the patterns 12*a* and 12*e*, the resistor $R_2$ is connected between the patterns 12*a* and 12*b*, the resistor $R_3$ is provided between the patterns 12*b* and 12*c*, and the resistor $R_4$ is provided between the patterns 12*b* and 12*d*, the resistors $R_1$ through $R_4$ may be either discrete resistors, or printed resistors printed on the circuit board 12 by the silk screen printing process. The diode $D_1$ is connected between the patterns 12*a* and 12*c*, the semiconductor switch $D_2$ is connected between the patterns 12*b* and 12*c*, and the diode $D_3$ is connected between the patterns 12*b* and 12*d* so that the polarity of those diodes and semiconductor switch conform with FIG. 1B. Also, the non-linear capacitor 11 is connected across the patterns 12*d* and 12*e* by the lead lines 11*d* and 11*e*. When the single non-linear capacitor 12 is utilized as shown in FIG. 4A, the capacitor 11 is located at the rear side of the printed circuit board 12 which does not have conductive patterns as shown in FIG. 4A with some space between the capacitor and the printed circuit board. When a pair of non-linear capacitors are utilized, each capacitors are located at both sides of the printed circuit board as shown in FIG. 4B. The lead lines 14 and 15 for supporting the printed circuit board 12 and connecting the same to an external circuit are connected to the patterns 12*b* and 12*a*, respectively. The connection of the circuit components and lead lines on the circuit board 12 is performed by the soldering.

Some modifications of FIGS. 5A and 5B are possible. For instance, the non-linear capacitor 11 can be adhered on the rear surface of the printed circuit board 12 so that the capacitor 11 is fixed firmly. Further, the dielectric disk 11*a* of the non-linear capacitor 11 can double as the dielectric plate 12A of the printed circuit board 12. In that case, the electrodes 11*b* and 11*c* of the capacitor 11 are provided on a part of the ferroelectric dielectric plate 11*a*, and conductive patterns 12*a* through 12*e* are provided on other portions of the dielectric plate 11*a* and the circuit components are mounted on that plate 11*a*. In this configuration, a separate printed circuit board 12 can be removed, and the apparatus can be smaller.

Figure 6:
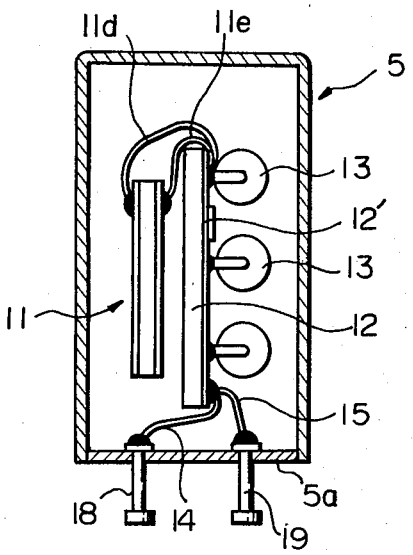
FIG. 6 shows the structure of another starter switch according to the present invention.

FIG. 6 is another structure of the present starter switch, in this embodiment, the dielectric circular bottom plate 5a is provided, and a pair of connector pins 18 and 19 are fixed to said bottom plate 5a. The printed circuit board 12 is connected those pins 18 and 19 by the lead lines 14 and 15. The dielectric cylindrical casing cover 5 covers the apparatus by fixing the same to the bottom plate 5a by snap fix or adhesive means. In the embodiment of FIG. 6, the cover 5 may be made of either non-conductive material like plastics, or conductive material like aluminum. The choice of the structure of FIG. 4A or FIG. 6 depends upon the structure of the socket that a fluorescent lamp system utilizes.

Figure 7A:
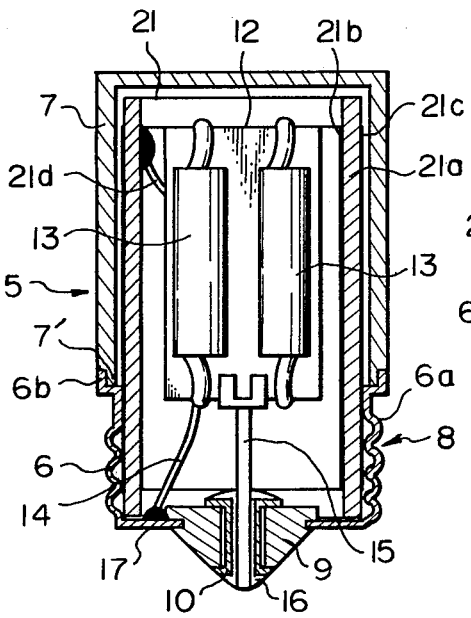
FIGS. 7A and 7B show still another embodiment of the starter switch according to the present invention.
Figure 7B:
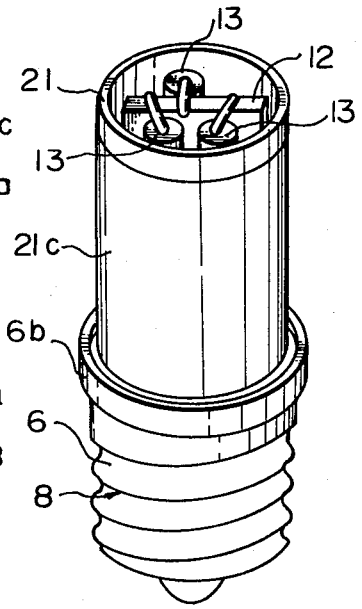

FIG. 7A is the cross sectional view of still another structure of the present starter switch, and FIG. 7B is the perspective view of the same with the casing 7 removed. The feature of this embodiment is the use of the cylindrical non-linear capacitor 21, which has the cylindrical ferroelectric dielectric body 21a, the inner electrode attached on the inner surface of said cylindrical body 21a, the outer electrode 21c attached on the outer surface of said cylindrical body 21a, and the lead line 21d connected to the inner electrode 21b. Other structure of the embodiment of FIGS. 7A and 7B is similar to that of FIG. 4A.

In FIGS. 7A and 7B, a housing 5 having a cylindrical casing cover 7 and a conductive screw cap 6 is provided. The cover 7 has a cylindrical side wall and a circular top plate, and the cover 7 is made of non-consuctive material like plastics. The screw cap 6 has a cylindrical side wall 6a which has screw 8, and is made of conductive material. The screw cap 6 has also a dielectric body 9 at the extreme end of the same and a conductive member 10 provided at the center of the dielectric body 9 so that the conductive member 10 is insulated from the screw cap 6. The structure of the screw cap 6, including the diameter, the length, and the pitch of the screw 8, is compatible with a conventional glow switch. The end of the screw cap 6 is fixed to the corresponding end of the cover 7 through for instance adhesive means. Preferably, a flange 7' is provided at the end of the cover 7, said flange 7' is engaged with the corresponding flange 6b at the end if the screw cap 6. The printed circuit board having the circuit elements 13 (including the diode $D_1$, the semiconductor switch $D_2$, the diode $D_3$, and the resistors $R_1$ through $R_4$, and excluding the non-linear capacitor $C_n$) is also provided.

The printed circuit board 12 is supported to the screw cap 6 by the lead lines 14 and 15, which double as lead lines for the electrical coupling between the circuit board 12 and a cap 6. The lead line 14 is connected to the screw cap 6 and the lead line 15 is connected to the conductive member 10. The printed circuit board 12 is inserted in the cylindrical capacitor 21 so that the outer electrode 21c contacts with the inner surface of the screw cap 6. The inner electrode 21b of the capacitor 21 is connected to the printed circuit board 12 by the lead line 21d. Then, the half assembly of the starter switch as shown in FIG. 7B is obtained. The starter switch is completed by covering the cover 7 on said half assembly.

The embodiment of FIGS. 7A and 7B which utilizes a cylindrical non-linear capacitor has the advantage that the confronting area of the electrodes 21b and 21c is considerably larger than that of the capacitor 11 of FIG. 4A, and a large amount of charge is stored in the capacitor, thus, the higher firing voltage is obtained and the stable firing operation is achieved.

Figure 8:
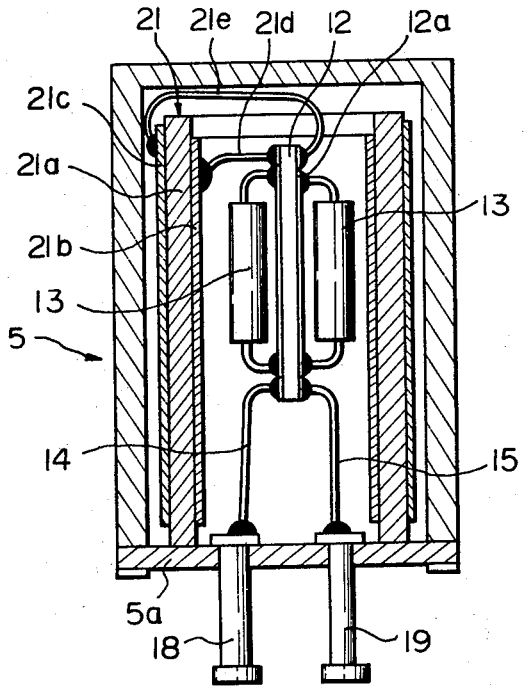
FIG. 8 shows the structure of the still another embodiment of the starter switch according to the present invention.
Figure 11:
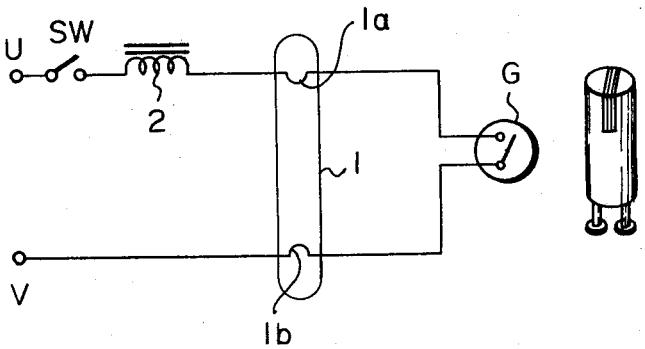
Fig. 11 PRIOR ART
FIG. 11 is the circuit diagram of a prior fluorescent lamp system.

FIG. 8 is still another embodiment of the present starter switch. This embodiment is the application of the embodiment of FIG. 6 to a cylindrical non-linear capacitor. In this embodiment, the dielectric circular bottom plate 5a is provided, and a pair of connector pins 18 and 19 are fixed to said bottom plate 5a. The printed circuit board 12 is connected to those pins 18 and 19 by the lead lines 14 and 15, and the cylindrical capacitor 21 connected to the circuit board 12 by the lead lines 21d and 21e. The housing cover 5 which is made of either plastics or aluminum covers the apparatus by fixing the same to the bottom plate 5a by snap fix or adhesive means. Of course the choice of the structure of FIGS. 7A and 7B, or FIG. 8 depends upon the structure of the socket that a fluorescent lamp system utilizes.

Now, the dielectric body of a non-linear capacitor is described. The non-linear capacitor must provide a high voltage to a fluorescent lamp, and the dielectric breakdown voltage must be high. The inventors realized in the experimentation that the above nature is implemented by using the combination of $B_aT_iO_3$, and $B_aS_nO_3$ as the dielectric body of a non-linear capacitor, and the combination ratio of two raw materials, the diameter of the material must be well controlled. (Experiment)

The raw materials $B_aCO_3$, $T_iO_2$ and $S_nO_2$ are mixed with the mineralizer additive $M_nCO_3$ and clay material in a pot in a wet condition. The mixture is dried, and is pre-sintered at the temperature 1150° C. for 2 hours. Then, the mixture is powdered so that the desited average diameter of powder is obtained. Then, a binder is added to the mixture powder and a disk of the diameter 16.5 mm and the thickness 0.6 mm is shaped by the 10 tons press machine. That disk is sintered at the temperature 1400°–1500° C. for 2 hours. Then, the picture of the crystal of the product is taken to inspect the average diameter of a crystal by counting the number of crystals in a unit length. Then, a pair of silver electrodes are attached on said product (dielectric disk) at the temperature 780° C. to provide a capacitor. The capacitor thus obtained is connected in the circuit of FIG. 1B as the non-linear capacitor $C_n$, and the amplitude of the pulse voltage PV (see FIG. 3) is measured, where the power source voltage is 100 volts. Also, the dielectric breakdown voltage of the disk is measured. The pulse voltage thus obtained, and the dielectric breakdown voltage depend upon the average diameter of crystals and the ratio of the materials. The results of the experiment are shown in FIGS. 9 and 10.

Figure 9:
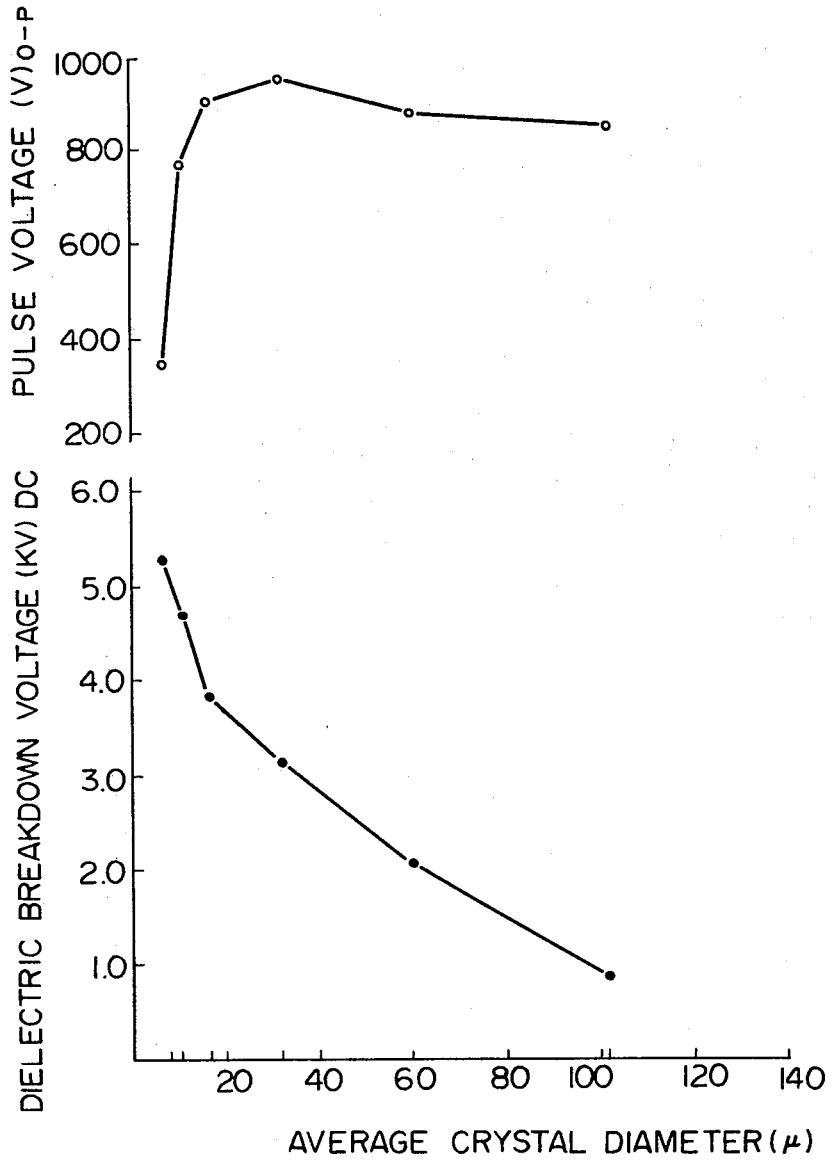
FIG. 9 and FIG. 10 show characteristics curves of the non-linear capacitor utilized in the present starter switch.

FIG. 9 shows the characteristics between the pulse voltage indued in a ballast and obtained by the capacitor (vertical axis) and the average diameter of crystals (horizontal axis), and the characteristics between the dielectric breakdown voltage (vertical axis) and the average diameter of crystals (horizontal axis). Of course, the higher pulse voltage, and the higher dielectric breakdown voltage are preferable. In FIG. 9, it should be appreciated that when the average diameter of crystals is in the range from 10μ (micron) to 60μ, the pulse voltage obtained is higher than 700 volts, which is satisfactory for firing a fluorescent lamp. When the average diameter of crystals exceeds 60μ, the dielectric breakdown voltage decreases too much. Therefore, the preferable average diameter of crystals is in the range from 10μ to 60μ.

Figure 10:
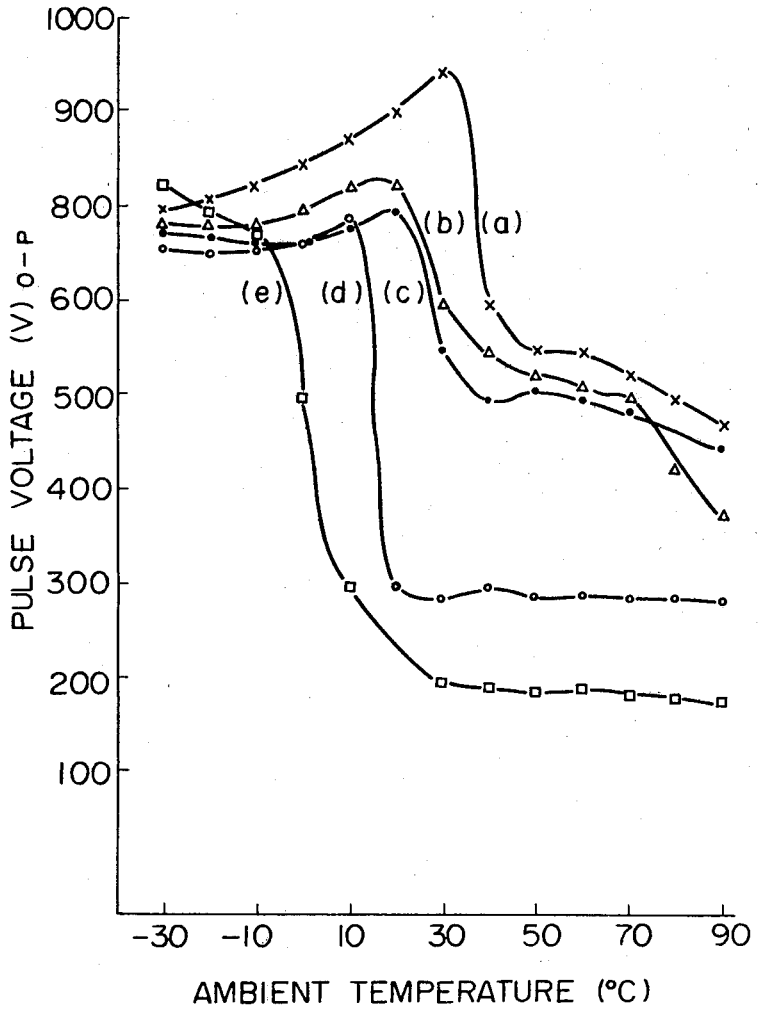

On the condition that the average diameter of crystals is in the above range, the effect of the ambient temperature and the ratio of the materials ($B_aT_iO_3$ and $B_aS_iO_3$)

to the obtained pulse voltage is measured as shown in FIG. 10, in which the horizontal axis shows the ambient temperature, the vertical axis shows the pulse voltage obtained, and the ratio (mol %) of the materials of the curves (a) through (e) is shown below.

| Curve | mol % | |
|---|---|---|
| | $B_a T_i O_3$ | $B_a S_n O_3$ |
| a | 96 | 4 |
| b | 90 | 10 |
| c | 98 | 2 |
| d | 100 | 0 |
| e | 84 | 16 |

It should be appreciated in FIG. 10 that when the mol % of $B_aT_iO_3$ is in the range from 90 to 98 (the mol % of $B_aT_iO_3$ is in the range from 2 to 10), the pulse voltage is higher than 500 volts which is enough to fire a lamp, at the temperature between −30° C. and +60° C. The curve (d) and the curve (e) are not good for firing a fluorescent lamp since the pulse voltage decreases in high temperature. Therefore, the preferable range of the mol % between $B_aT_iO_3$ and $B_aS_nO_3$ is that the mol % of $B_aT_iO_3$ is in the range from 90 to 98, and the mol % of $B_aT_iO_3$ is in the range from 10 to 2.

As mentioned above in detail, the present starter switch which has a non-linear capacitor and a switching circuit can replace a conventional glow switch, and provides a rapid firing of a fluorescent lamp.

From the foregoing, it will now be apparent that a new and improved starter switch for a fluorescent lamp has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A rapid starter switch for a fluorescent lamp to be connected in series with a ballast, and a pair of filaments of a fluorescent lamp comprising:

(a) a connector cap for connecting electrically the present starter switch to an external circuit and supporting the same, and said cap being able to be engaged with a socket for a glow switch for a fluorescent lamp, (b) a printed circuit board suspending a non-linear capacitor having the non-linear characteristics between a voltage applied to the capacitor and the charge stored in the capacitor, and mounting a semiconductor switching circuit connected substantially parallel to that non-linear capacitor, said non-linear capacitor being suspended by a pair of lead lines for absorbing vibration of the non-linear capacitor on said printed circuit board, (c) a pair of lead lines for providing the electrical coupling between said printed circuit board and said cap, and for supporting said printed circuit board, and (d) a casing coupled to said cap and covering said printed circuit board and said lead lines.

2. A rapid starter switch according to claim 1, wherein said cap is a screw cap.

3. A rapid starter switch according to claim 1, wherein said cap has a dielectric circular disk and a pair of connector pins.

4. A rapid starter switch according to claim 1, wherein said casing is made of plastics.

5. A rapid starter switch according to claim 3, wherein said casing is made of aluminum.

6. A rapid starter switch according to claim 1, wherein a first diode is connected in series with said non-linear capacitor, and a second diode is connected in series with said switching circuit so that the polarity of the latter is opposite to that of the former.

7. A rapid starter switch according to claim 1, wherein said non-linear capacitor has a dielectric layer composed of polycrystal body of $B_aT_iO_3$ and $B_aS_nO_3$ with the moll ratio $B_aT_iO_3$ 90 through 98 mol % and $B_aS_nO_3$ 10 through 2 mol % and the average diameter of a sintered body of the dielectric layer is in the range from 10μ to 60μ.

8. A rapid starter switch according to claim 1, wherein two non-linear capacitors connected parallel to each other are provided.

9. A rapid starter switch according to claim 1, wherein said non-linear capacitor has a pair of lead lines for the electrical coupling of the non-linear capacitor to the printed circuit board and supporting the non-linear capacitor, the length of each of lead lines is longer than 7 mm, and the diameter of each lead lines is in the range from 0.5 mm to 0.8 mm.

10. A rapid starter switch for a fluorescent lamp to be connected in series with a ballast and a pair of filaments of a fluorescent lamp comprising:

(a) a cap for connecting electrically the present starter switch to an external circuit and supporting the present starter switch, and said cap being able to be engaged with a socket for a glow switch for a fluorescent lamp, (b) a non-linear capacitor having the non-linear characteristics between a voltage applied to the capacitor and the charge stored in the capacitor, said nonlinear capacitor being in cylindrical shape having a cylindrical dielectric body and an inner electrode attached to the inner surface of the cylindrical dielectric body and an outer electrode attached on the outer surface of the cylindrical dielectric body, and said non-linear capacitor being fixed to said cap, (c) a printed circuit board mounting at least a semiconductor switching circuit, said printed circuit board being suspended substantially parallel to said cylindrical non-linear capacitor by lead lines (21*d*, 21*e*) and another pair of lead lines (14, 15) which provide the electrical coupling between said printed circuit board and said cap, said lead lines absorbing vibration of said non-linear capacitor, and (d) a housing coupled to said cap and covering said cylindrical non-linear capacitor.

11. A rapid starter switch according to claim 10, wherein said cap is a screw cap having a cylindrical screwed wall, a dielectric body fixed at the end of said screwed wall, and a conductive member fixed at the center of said dielectric body, and an inner surface of the cap touches directly with the outer electrode of said non-linear capacitor.

12. A rapid starter switch according to claim 10, wherein said cap has a dielectric circular disk and a pair of connector pins.

13. A rapid starter switch according to claim 10, wherein said housing is made of dielectric plastics.

14. A rapid starter switch according to claim 10, wherein a pair of diodes are mounted on said printed circuit board so that a first diode is connected in series with said non-linear capacitor and a second diode is connected in series with said switching circuit, so that the polarity of the former is opposite to that of the latter.

15. A rapid starter switch according to claim 10, wherein the dielectric body of said non-linear capacitor is composed of polycrystal body of $B_aT_iO_3$ and $B_aS_nO_3$ with the mol ratio $B_aT_iO_3$ 90 through 98 mol % and $B_aS_nO_3$ 10 through 2 mol %, and the average diameter of a sintered body of the dielectric body is in the range from 10μ to 60μ.

16. A rapid starter switch for a fluorescent lamp to be connected in series with a ballast and a pair of filaments of a fluorescent lamp comprising:

(a) first means for connection to a source of alternating current;

(b) a printed circuit board including switching means supported from said first means;

(c) a ferroelectric capacitor having a non-linear dielectric material portion composed at least in part of means that causes the capacitor to produce vibrations when alternating current is applied thereto because said means has non-linear characteristics between a voltage applied to the capacitor and the charge stored in the capacitor, such that the capacitor mechanically vibrates when an alternating current voltage is applied to the capacitor from the first means, and whereby the switching means and capacitor are adapted to be put into operable association as a rapid starter switch for the series connection;

(d) a pair of lead lines for providing electrical coupling between said printed circuit board and said first means and which double as a support for supporting the printed circuit board; and (e) another pair of lead lines electrically connected between said printed circuit board and said non-linear capacitor with a length and diameter for electrically conducting alternating current in the series, for supporting the weight of the capacitor, and for absorbing the vibration of the capacitor for preventing the transfer of the vibration to the printed circuit board.

17. The rapid starter switch of claim 16 in which the other pair of lead lines are equal length copper lead lines having a length longer than about 7 mm, and a diameter of between about 0.5 mm and 0.8 mm.

18. The rapid starter of claim 16 in which the first means is an electrically connecting cap.

* * * * *